US009583041B2

(12) United States Patent
Yin et al.

(10) Patent No.: US 9,583,041 B2
(45) Date of Patent: Feb. 28, 2017

(54) PIXEL CIRCUIT AND DRIVING METHOD THEREOF, DISPLAY PANEL, AND DISPLAY DEVICE

(71) Applicant: BOE TECHNOLOGY GROUP CO., LTD., Beijing (CN)

(72) Inventors: Jingwen Yin, Beijing (CN); Zhongyuan Wu, Beijing (CN)

(73) Assignee: Boe Technology Group Co., Ltd., Beijing (CN)

( * ) Notice: Subject to any disclaimer, the term of this patent is extended or adjusted under 35 U.S.C. 154(b) by 112 days.

(21) Appl. No.: 14/429,827

(22) PCT Filed: Aug. 4, 2014

(86) PCT No.: PCT/CN2014/083619

§ 371 (c)(1),
(2) Date: Mar. 20, 2015

(87) PCT Pub. No.: WO2015/127760

PCT Pub. Date: Sep. 3, 2015

(65) Prior Publication Data

US 2016/0247449 A1 Aug. 25, 2016

(30) Foreign Application Priority Data

Feb. 28, 2014 (CN) ..... 2014 1 0073340

(51) Int. Cl.
*G09G 5/10* (2006.01)
*G09G 3/32* (2016.01)

(52) U.S. Cl.
CPC ..... *G09G 3/3258* (2013.01); *G09G 3/3233* (2013.01); *G09G 2300/043* (2013.01);
(Continued)

(58) Field of Classification Search
None
See application file for complete search history.

(56) References Cited

U.S. PATENT DOCUMENTS

2005/0052377 A1* 3/2005 Hsueh ..... G09G 3/3233 345/82
2008/0203930 A1* 8/2008 Budzelaar ..... G09G 3/3233 315/169.1

(Continued)

FOREIGN PATENT DOCUMENTS

CN 1517965 8/2004
CN 1591104 3/2005

(Continued)

OTHER PUBLICATIONS

Office action from Chinese Application No. 201410073340.7 dated Apr. 11, 2016.

(Continued)

*Primary Examiner* — Christopher R Lamb
(74) *Attorney, Agent, or Firm* — Calfee, Halter & Griswold LLP

(57) ABSTRACT

The present invention discloses a pixel circuit and a driving method thereof, a display panel, and a display device, so as to improve brightness uniformity. The pixel circuit in the present invention comprises a control sub-circuit, a compensation sub-circuit, a driving transistor and a light emitting device. The present invention enables the driving current that drives the light emitting device to emit light to be uncorrelated with the threshold voltage of the driving transistor, so as to improve display uniformity of the panel.

13 Claims, 10 Drawing Sheets

(52) U.S. Cl.
CPC ..... *G09G 2300/0819* (2013.01); *G09G 2300/0852* (2013.01); *G09G 2300/0861* (2013.01); *G09G 2310/0251* (2013.01); *G09G 2310/0262* (2013.01); *G09G 2320/0233* (2013.01); *G09G 2320/045* (2013.01); *G09G 2320/0626* (2013.01)

(56) References Cited

U.S. PATENT DOCUMENTS

| | | | | |
|---|---|---|---|---|
| 2012/0062618 | A1* | 3/2012 | Ono | G09G 3/3233 345/690 |
| 2014/0253612 | A1* | 9/2014 | Hwang | G09G 3/3258 345/691 |

FOREIGN PATENT DOCUMENTS

| | | |
|---|---|---|
| CN | 1677470 | 10/2005 |
| CN | 101079234 | 11/2007 |
| CN | 101123070 | 2/2008 |
| CN | 101582235 | 11/2009 |
| CN | 101740606 | 6/2010 |
| CN | 102428508 | 4/2012 |
| CN | 10294564 | 2/2013 |
| CN | 102945654 | 2/2013 |
| CN | 102971781 | 3/2013 |
| CN | 103021332 | 4/2013 |
| CN | 103165080 | 6/2013 |
| CN | 103310732 | 9/2013 |
| CN | 203288217 | 11/2013 |
| CN | 103514833 | 1/2014 |
| CN | 103578428 | 2/2014 |
| CN | 103839520 | 6/2014 |
| CN | 203733448 | 7/2014 |
| KR | 10-2006-0024869 | 3/2006 |
| KR | 10-0658257 | 12/2006 |
| WO | 2006/130981 | 12/2006 |

OTHER PUBLICATIONS

Translation of International Search Report and Written Opinion from PCT/CN2014/083619 dated Nov. 26, 2014.
Office action from Chinese Application No. 201410073340.7 dated Jul. 21, 2015.
International Search Report and Written Opinion from PCT/CN2014/083619 dated Nov. 26, 2014.

* cited by examiner

PIXEL CIRCUIT AND DRIVING METHOD THEREOF, DISPLAY PANEL, AND DISPLAY DEVICE

RELATED APPLICATIONS

This application is the U.S. national stage entry of PCT/CN2014/083619 with an international filing date of Aug. 4, 2014, which claims priority to and any other benefit of Chinese Application No. 201410073340.7 filed Feb. 28, 2014 and entitled "Pixel circuit and driving method thereof, display panel, and display device," the entire disclosures of which are incorporated by reference herein.

FIELD OF THE INVENTION

The present invention relates to the field of display technology, particularly to a pixel circuit and a driving method thereof; a display panel; and a display device.

BACKGROUND OF THE INVENTION

With the rapid progress of multimedia technology, related technology, such as semiconductor element and display technology, have also progressed accordingly.

The Organic Light Emitting Diode (OLED) display has advantages over previous technology, including lower power consumption, high brightness, lower cost, wide view, faster response speeds. Because of these advantages, OLED and has been widely applied in the field of organic light emitting technology.

A number of issues may occur in the production of an OLED display device. There is non-uniformity in structure, non-uniformity in electrical performance, and lack of stability during fabrication of the driving transistor. The threshold voltage (Vth) of the transistor may produce drift, resulting in the current flowing through the light emitting device to be different with changes in the voltage, thereby causing the brightness of the display panel to vary between positions. This results in non-uniformity in brightness of the display, as well as non-uniformity in other aspects.

SUMMARY OF THE INVENTION

The object of the present invention is to provide a pixel circuit and a driving method thereof, a display panel and a display device, so as to solve the problem of bad brightness uniformity and brightness constancy of the display panel caused by the existing pixel circuit.

The object of the present invention is achieved by means of the following technical solutions:

At the first aspect, the present invention provides a pixel circuit comprising a control sub-circuit, a compensation sub-circuit, a driving is transistor and a light emitting device, wherein, a gate of the driving transistor is connected with the compensation sub-circuit, a drain of the driving transistor is connected with a variable voltage source, a source of the driving transistor is connected with the light emitting device;

the control sub-circuit is connected with the compensation sub-circuit, for controlling charging and discharging of the compensation sub-circuit under control of a scanning signal and a charging signal;

the control sub-circuit is connected with the driving transistor and the light emitting device, for controlling the driving transistor to drive the light emitting device to emit light under control of a light-emitting control signal;

the compensation sub-circuit performs electric potential reset under control of the control sub-circuit, and is used for storing a threshold voltage of the driving transistor, so as to compensate the threshold voltage of the driving transistor when the driving transistor drives the light emitting device to emit light.

The compensation sub-circuit in the pixel circuit according to the embodiment of the present invention, under the control of the control sub-circuit, can accomplish electric potential reset and store the threshold voltage of the driving transistor, and can compensate the threshold voltage of the driving transistor better when the driving transistor drives the light emitting device to emit light, finally enabling the driving current that drives the light emitting device to emit light to be uncorrelated with the threshold voltage of the driving transistor, so as to improve display uniformity of the panel.

Specifically, the compensation sub-circuit comprises a first capacitor, a second capacitor and a first switch transistor, wherein, a first end of the first capacitor is connected with the control sub-circuit and a second end of the second capacitor, a second end of the first capacitor is connected the gate of the driving transistor and the drain of the first switch transistor;

a first end of the second capacitor is connected with a reference voltage source, the second end of the second capacitor is connected with the first end of the first capacitor;

a gate of the first switch transistor is connected with a first gate signal source, the drain of the first switch transistor is connected with the gate of the driving transistor and the second end of the first capacitor, a source of the first switch transistor is connected with the source of the driving transistor;

the control sub-circuit controls charging and discharging of the first capacitor and the second capacitor, so as to enable the electric potential stored at the connection end of the first capacitor and the second capacitor to be reset, and controls the first switch transistor to be switched on, so as to enable the first capacitor to be charged and discharged in a diode connection mode of the driving transistor, thereby enabling the first capacitor to store the threshold voltage of the driving transistor, and accomplishing storing of the threshold voltage of the driving transistor at the same time of accomplishing the reset.

Specifically, the control sub-circuit comprises a charging control module and a light-emitting control module, wherein, the charging control module is connected with the first end of the first capacitor and the second end of the second capacitor, for controlling charging and discharging of the first capacitor and the second capacitor under control of the scanning signal and the charging signal, so as to enable the electric potential stored at the connection end of the first capacitor and the second capacitor to be reset, and for controlling the first switch transistor to be switched on, so as to enable the first capacitor to be charged and discharged under in the diode connection mode of the driving transistor, thereby enabling the first capacitor to store the threshold voltage of the driving transistor; and further for receiving a data voltage signal that drives the light emitting device to emit light, so as to control the first capacitor and the second capacitor to store the data voltage for driving the light emitting device to emit light;

the light-emitting control module is connected with the source of the driving transistor as well as the light emitting device, for enabling the driving transistor to drive the light emitting device to emit light under control of the light-emitting control signal.

Specifically, the charging control module comprises a second switch transistor, wherein, a drain of the second switch transistor is connected with a data voltage source, a gate of the second switch transistor is connected with a second gate signal source, a source of the second switch transistor is connected with the first end of the first capacitor and the second end of the second capacitor.

Specifically, the light-emitting control module comprises a third switch transistor, wherein, a gate of the third switch transistor is connected with a third gate signal source, a drain of the third switch transistor is connected with the source of the driving transistor, a source of the third switch transistor is connected with an anode of the light emitting device.

Further, the pixel circuit further comprises a fourth switch transistor, wherein, a gate of the fourth switch transistor is connected with the first gate signal source, a drain of the fourth switch transistor is connected with the second end of the second capacitor and the first end of the first capacitor, a source of the fourth switch transistor is connected with the drain of the driving transistor.

Specifically, the first switch transistor, the second switch transistor, the third switch transistor and the fourth switch transistor are all P-type transistors or all N-type transistors, so as to simplify the fabricating process.

At the second aspect, a driving method of a pixel circuit is provided, comprising:

an initialization phase: a variable voltage source outputting a low potential voltage to a drain of a driving transistor, a control sub-circuit controlling a compensation sub-circuit to perform electric potential reset, and controlling the driving transistor to enter into a switch-off state, so as to enable the compensation sub-circuit to store a threshold voltage of the driving transistor;

a data writing phase: the variable voltage source outputting a high potential voltage to the drain of the driving transistor, the control sub-circuit controlling a data voltage signal that drives the light emitting device to emit light to be written into the compensation sub-circuit;

a light-emitting phase: the variable voltage source outputting a high potential voltage to the drain of the driving transistor, the control sub-circuit controlling the driving transistor to drive the light emitting device to emit light, and the threshold voltage of the driving transistor being compensated by the threshold voltage stored by the compensation sub-circuit, thereby enabling a current value of a driving current generated by the driving transistor to be uncorrelated with the threshold voltage of the driving transistor.

In the driving method of a pixel circuit according to the embodiment of the present invention, the compensation sub-circuit can accomplish resetting of the driving transistor and store the threshold voltage of the driving transistor, and can compensate the threshold voltage of the driving transistor better when the driving transistor drives the light emitting device to emit light, finally enabling the driving current that drives the light emitting device to emit light to be uncorrelated with the threshold voltage of the driving transistor, so as to improve display uniformity of the panel.

Optimally, the compensation sub-circuit comprises a first capacitor, a second capacitor and a first switch transistor, wherein, The control sub-circuit controls the compensation sub-circuit to perform potential reset, and controls the driving transistor to enter into the switch-off state, so as to enable the compensation sub-circuit to store the threshold voltage of the driving transistor, specifically comprising:

a reference voltage source outputting potential of a reference reset voltage, the control sub-circuit controlling charging and discharging of the first capacitor and the second capacitor, so as to enable the potential stored at the connection end of the first capacitor and the second capacitor to be reset as the potential of the reference reset voltage;

a first gate signal source outputting a level signal that enables the first switch transistor to be switched on, thereby enabling the driving transistor to be in a diode connection mode, and controlling charging and discharging of the first capacitor in the diode connection mode of the driving transistor, so as to enable the driving transistor to enter into the switch-off state, thereby enabling the first capacitor to store the threshold voltage of the driving transistor.

By means of the above driving method, the driving transistor can enter into the switch-off state and the storing of the threshold voltage of the driving transistor can be accomplished at the same time that the reset is accomplished.

Further, the pixel circuit further comprises a second switch transistor and a third switch transistor, wherein, the initialization phase specifically comprises:

the first gate signal source outputting a level signal that enables the first switch transistor to be switched on, a second gate signal source outputting a level signal that enables the second switch transistor to be switched on, a third gate signal source outputting a level signal that enables the third switch transistor to be switched off, the reference voltage source outputting the potential of the reference reset voltage to an end of the second capacitor that is not connected with the first capacitor, the data voltage source outputting a low potential voltage to the connection end of the first capacitor and the second capacitor through the switched on second switch transistor, so as to enable the connection end of the first capacitor and the second capacitor to store the potential of the reference reset voltage, the first capacitor is charge and discharged in the diode connection mode of the driving transistor, so as to enable the driving transistor to enter into the switch-off state, thereby enabling the first capacitor to store the threshold voltage of the driving transistor;

the data writing phase specifically comprises:

the first gate signal source outputting a level signal that enables the first switch transistor to be switched off, the second gate signal source outputting a level signal that enables the second switch transistor to be switched on, the third gate signal source outputting a level signal that enables the third switch transistor to be switched off, the data voltage source outputting a data voltage signal, the second capacitor storing the data voltage;

the light-emitting phase specifically comprises:

the first gate signal source outputting a level signal that enables the first switch transistor to be switched off, the second gate signal source outputting a level signal that enables the second switch transistor to be switched off, the third gate signal source outputting a level signal that enables the third switch transistor to be switched on, the driving transistor driving the light emitting device to emit light, and the threshold voltage of the driving transistor being compensated by the threshold voltage stored by the first capacitor, thereby enabling the current value of the driving current generated by the driving transistor to be uncorrelated with the threshold voltage of the driving transistor.

Further, the pixel circuit further comprises a fourth switch transistor, wherein, the initialization phase specifically comprises:

the first gate signal source outputting a level signal that enables the first switch transistor and the fourth switch transistor to be switched on, the second gate signal source outputting a level signal that enables the second switch transistor to be switched off, the third gate signal source outputting a level signal that enables the third switch transistor to be switched off, the reference voltage source outputting the potential of the reference reset voltage to an end of the second capacitor that is not connected with the first capacitor, the variable voltage source outputting a low potential voltage to the connection end of the first capacitor and the second capacitor through the switched on fourth switch transistor, the connection end of the first capacitor and the second capacitor storing the potential of the reference reset voltage, the first capacitor being charged and discharged in the diode connection mode of the driving transistor, so as to enable the driving transistor to enter into the switch-off state, thereby enabling the first capacitor to store the threshold voltage of the driving transistor;

the data writing phase specifically comprises:

the first gate signal source outputting a level signal that enables the first switch transistor and the fourth switch transistor to be switched off, the second gate signal source outputting a level signal that enables the second switch transistor to be switched on, the third gate signal source outputting a level signal that enables the third switch transistor to be switched off, the data voltage source outputting a data voltage signal, the second capacitor storing the data voltage;

the light-emitting phase specifically comprises:

the first gate signal source outputting a level signal that enables the first switch transistor and the fourth switch transistor to be switched off, the second gate signal source outputting a level signal that enables the second switch transistor to be switched off, the third gate signal source outputting a level signal that enables the third switch transistor to be switched on, the driving transistor driving the light emitting device to emit light, and the threshold voltage of the driving transistor being compensated by the threshold voltage stored by the first capacitor, thereby enabling the current value of the driving current generated by the driving transistor to be uncorrelated with the threshold voltage of the driving transistor.

The driving method of a pixel circuit according to the embodiment of the present invention inputs different voltage potentials through the variable voltage source in the initialization phase and the data writing phase, and accomplishes potential reset and storing of the threshold voltage at the same time through the compensation sub-circuit, so as to compensate the threshold voltage of the driving transistor when the driving transistor drives the light emitting device to emit light, finally enabling the driving current that drives the light emitting device to emit light to be uncorrelated with the threshold voltage of the driving transistor, so as to improve display uniformity of the panel.

At the third aspect, a display panel is provided, comprising pixel units arranged in a matrix and defined by gate lines and data lines, each of the pixel units comprises a pixel circuit;

wherein the pixel circuit is a pixel circuit mentioned above.

Specifically, the display panel further comprises a first power signal line, a second power signal line, a first control signal line and a second control signal line, wherein, a drain of the driving transistor is connected with a variable voltage source through the first power signal line;

a first end of the second capacitor is connected with a reference to voltage source through the second power signal line;

a gate of the first switch transistor is connected with a first gate signal source through the first control signal line;

a gate of the second switch transistor is connected with a second gate signal source through the gate line, a drain of the second switch transistor is connected with a data voltage source through the data line;

a gate of the third switch transistor is connected with a third gate signal source through the second control signal line.

The pixel circuit in the display panel according to the embodiment of the present invention can accomplish potential reset, and store the threshold voltage of the driving transistor, and can compensate the threshold voltage of the driving transistor better when the driving transistor drives the light emitting device to emit light, finally enabling the driving current that drives the light emitting device to emit light to be uncorrelated with the threshold voltage of the driving transistor, so as to improve display uniformity of the panel.

At the fourth aspect, a display device is further provided, the display device comprises a display panel mentioned above.

In the display device according to the embodiment of the present invention, the pixel circuit of the display panel can accomplish potential reset, and store the threshold voltage of the driving transistor, and can compensate the threshold voltage of the driving transistor better when the driving transistor drives the light emitting device to emit light, finally enabling the driving current that drives the light emitting device to emit light to be uncorrelated with the threshold voltage of the driving transistor, so as to improve display uniformity of the panel.

DETAILED DESCRIPTION OF THE INVENTION

Embodiments of the present invention will be described clearly and completely in combination with the drawings. The embodiments described herein are only part rather than all of the embodiments of the present invention. Based on the disclosure, other embodiments may be contemplated by a person having ordinary skill in the art that fall withing the scope of the present invention.

A pixel circuit, as described herein, may be used for driving each pixel in a display device to create and image display.

It should be noted that the switch transistors and the driving transistors adopted in the embodiments of the present invention may be thin film transistors, field effect transistors, or other devices with the same properties. The source and the drain of the transistors adopted herein are symmetrical such that the source and the drain thereof are interchangeable. In embodiments of the present invention, in order to distinguish the two poles, one of the poles will be referred to as a source, and the other pole will be referred to as a drain.

It should be further noted that the description on "connection" of element A and element B involved in the embodiments of the present invention may indicate that A and B are directly connected, and may also indicate that A and B are indirectly connected through an element between A and B (e.g., A and B are connected through element C). By contrast, when it is called that element A "directly connects" B, it indicates that no element exists between A and B.

Figure 1:
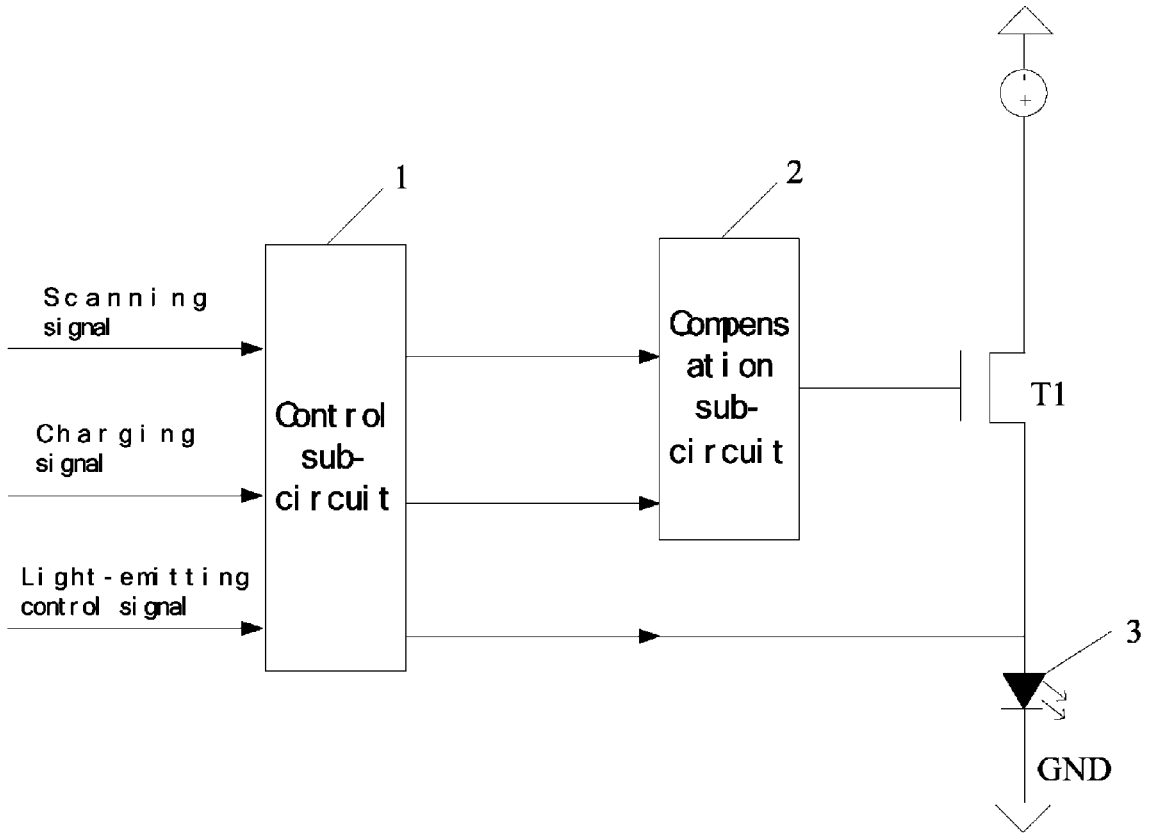
FIG. 1 is a schematic view of a first structure of a pixel circuit according to an embodiment of the present invention.

FIG. 1 shows a schematic view of structure of a pixel circuit according to an embodiment of the present invention. As shown in FIG. 1, the pixel circuit includes a control sub-circuit 1, a compensation sub-circuit 2, a driving transistor T1, and a light emitting device 3. The gate of the driving transistor T1 is connected to the compensation sub-circuit 2, the drain of the driving transistor T1 is connected to a variable voltage source, and the source of the driving transistor T1 is connected to the light emitting device 3.

In some embodiments, the control sub-circuit 1 is connected to the compensation sub-circuit 2 and controls the compensation sub-circuit 2. The compensation sub-circuit 2 performs charging and discharging under control of a scanning signal and a charging signal.

Further, in some embodiments, the control sub-circuit 1 is connected to the driving transistor T1 and the light emitting device 3. The sub-circuit 1 may control the driving transistor T1 by driving the light emitting device 3 to emit light under control of a light-emitting control signal.

The compensation sub-circuit 2 performs electric potential reset under control of the control sub-circuit 1, and may store a threshold voltage of the driving transistor T1. The stored threshold voltage may compensate the threshold voltage of the driving transistor T1 when the driving transistor T1 drives the light emitting device 3 to emit light.

In some embodiments, for example, light emitting device 3 may be an organic light emitting device, such as an OLED, the driving transistor T1 may be an N-type transistor, and may also be a P-type transistor. In FIG. 1, the light emitting device is an OLED and the driving transistor is an N-type transistor.

Figure 2:
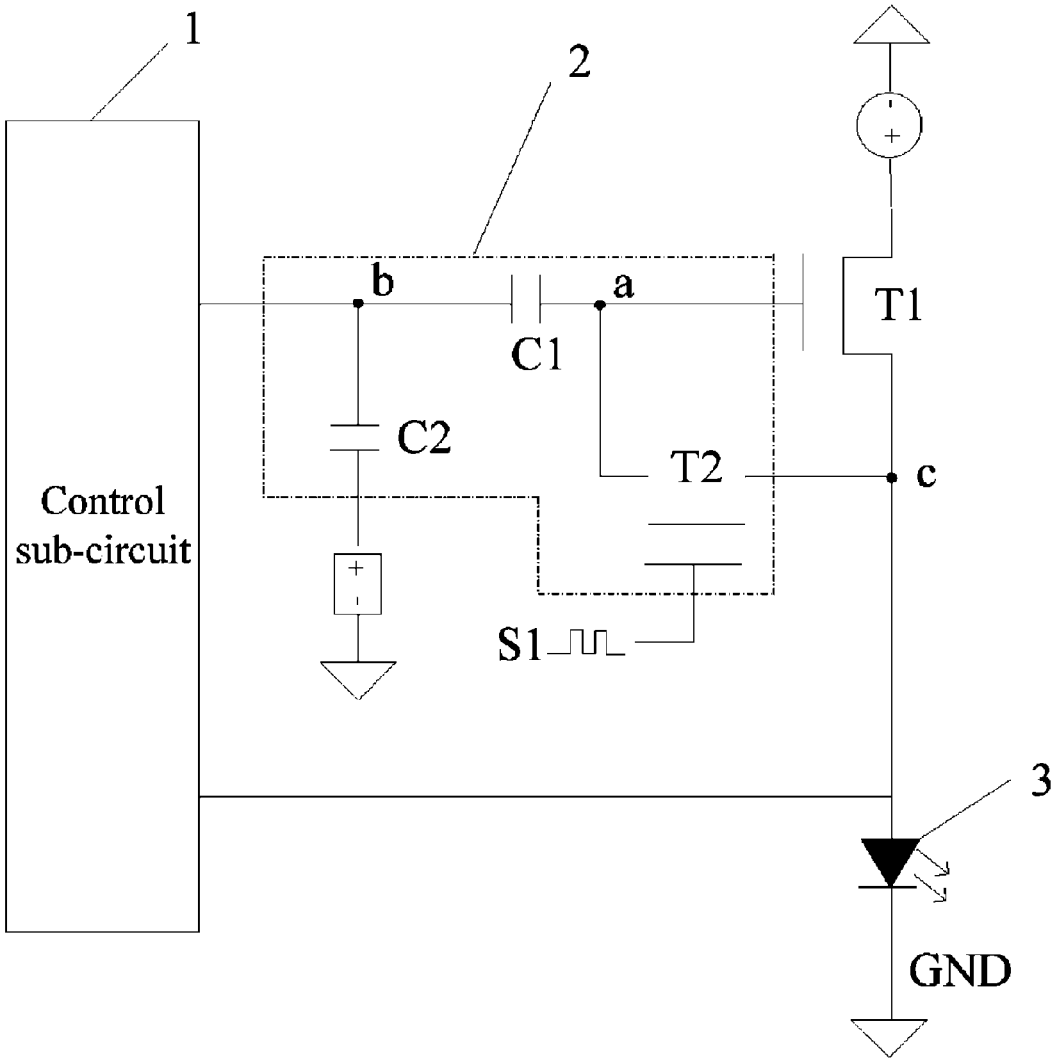
FIG. 2 is a schematic view of a second structure of a pixel circuit according to an embodiment of the present invention.

FIG. 2 shows another schematic view of structure of a pixel circuit according to an embodiment of the present invention. As shown in FIG. 2, the compensation sub-circuit 2 may be comprised of a first capacitor C1, a second capacitor C2, and a first switch transistor T2. The components of the circuit of FIG. 2 may be connected as follows:

The first end of the first capacitor C1 is connected to the control sub-circuit 1 and the second end of the second capacitor C2. The second end of the first capacitor C1 is connected to the gate of the driving transistor T1 and the drain of the first switch transistor T2.

The first end of the second capacitor C2 is connected to a reference voltage source. The second end of the second capacitor C2 is connected to the first end of the first capacitor C1.

The gate of the first switch transistor T2 is connected to a first gate signal source S1.

The drain of the first switch transistor T2 is connected to the gate of the driving transistor T1 and the second end of the first capacitor C1. The source of the first switch transistor T2 is connected to the source of the driving transistor T1.

In some embodiments, the gate of the driving transistor T1, the drain of the first switch transistor T2, and the second end of the first capacitor C1 may be connected at a node "a," as illustrated. Additionally or alternatively, the source of the driving transistor T1 and the source of the first switch transistor T2 may be connected at a node "c," as illustrated. Additionally or alternatively, the second end of the second capacitor C2 and the first end of the first capacitor C1 may be connected at a node "b," as illustrated.

The first end of the second capacitor C2 is connected with a reference voltage source that outputs a reference reset voltage, thus making the potential of the first end of the second capacitor equal to the potential of the reference reset voltage. The control sub-circuit 1 controls charging and discharging of the first capacitor C1 and the second capacitor C2 under the control of a scanning signal and a charging signal (it may depend on the display signal of the previous frame of image whether the first capacitor C1 and/or the second capacitor C2 are specifically charged or discharged). This enables the potential at the connection end of the first capacitor C1 and the second capacitor C2 to be reset to the potential of the reference reset voltage, thus storing the reference reset voltage at the node "b." The first gate signal source S1 outputs a level signal that controls switch-on or switch-off of the first switch transistor T2. Under the control of the level signal outputted by the first gate signal source S1, the first switch transistor T2 can be switched on, which enables the first capacitor C1 to be discharged in the diode connection mode of the driving transistor T1, thereby enabling the driving transistor T1 to be switched off, and storing the threshold voltage of the driving transistor T1 at the second end of the first capacitor C1, i.e., at the node "a." Therefore, the compensation sub-circuit resets the potential and storing of the threshold voltage of the driving transistor T1.

Figure 3:
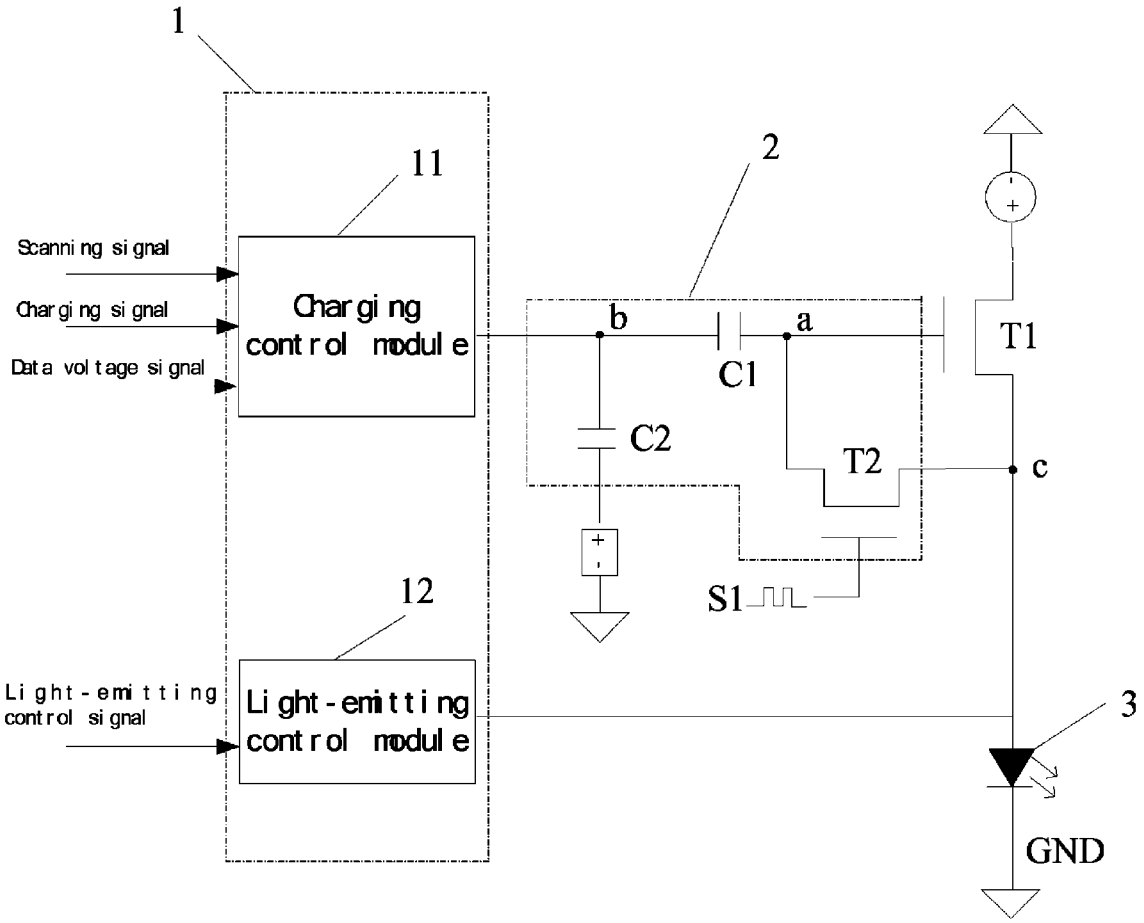
FIG. 3 is a schematic view of a third structure of a pixel circuit according to an embodiment of the present invention.

Referring to FIG. 3, a schematic of structure of a pixel circuit is provided. In some embodiments, the control sub-circuit 1 may include a charging control module 11 and a light-emitting control module 12. The charging control module 11 is connected to the first end of the first capacitor C1 and the second end of the second capacitor C2. The charging control module 11 controls charging and discharging of the first capacitor C1 and the second capacitor C2 under the control of the scanning signal and the charging signal, thus resetting and storing the threshold voltage. In some embodiments, the charging control module 11 may be further utilized to receive a data voltage signal that drives the light emitting device 3 to emit light, thus controlling the first capacitor C1 and the second capacitor C2 to store a data voltage for driving the light emitting device to emit light. The light-emitting control module 12 is connected to the source of the driving transistor T1 and the light emitting device 3, and enables the driving transistor T1 to drive the light emitting device 3 to emit light under the control of the light-emitting control signal. It should be noted that in the embodiment as shown in FIG. 3, the expressions "charging signal" and "data voltage signal" are used for describing functions of the pixel circuit in different time phases (i.e., in the phase of controlling charging and discharging of the first capacitor C1 and the second capacitor C2, resetting electric potential and storing of the threshold voltage; in the phase of controlling the first capacitor C1 and the second capacitor C2, storing the data voltage for driving the light emitting device 3 to emit light). In some embodiments, the charging signal may be part of the data voltage signal (i.e., the two may come from the same signal source). For example, the data voltage signal may be referred to as a charging signal in the phase of controlling charging and discharging of the first capacitor C1 and the second capacitor C2 to reset electric potential and store the threshold voltage.

Figure 4:
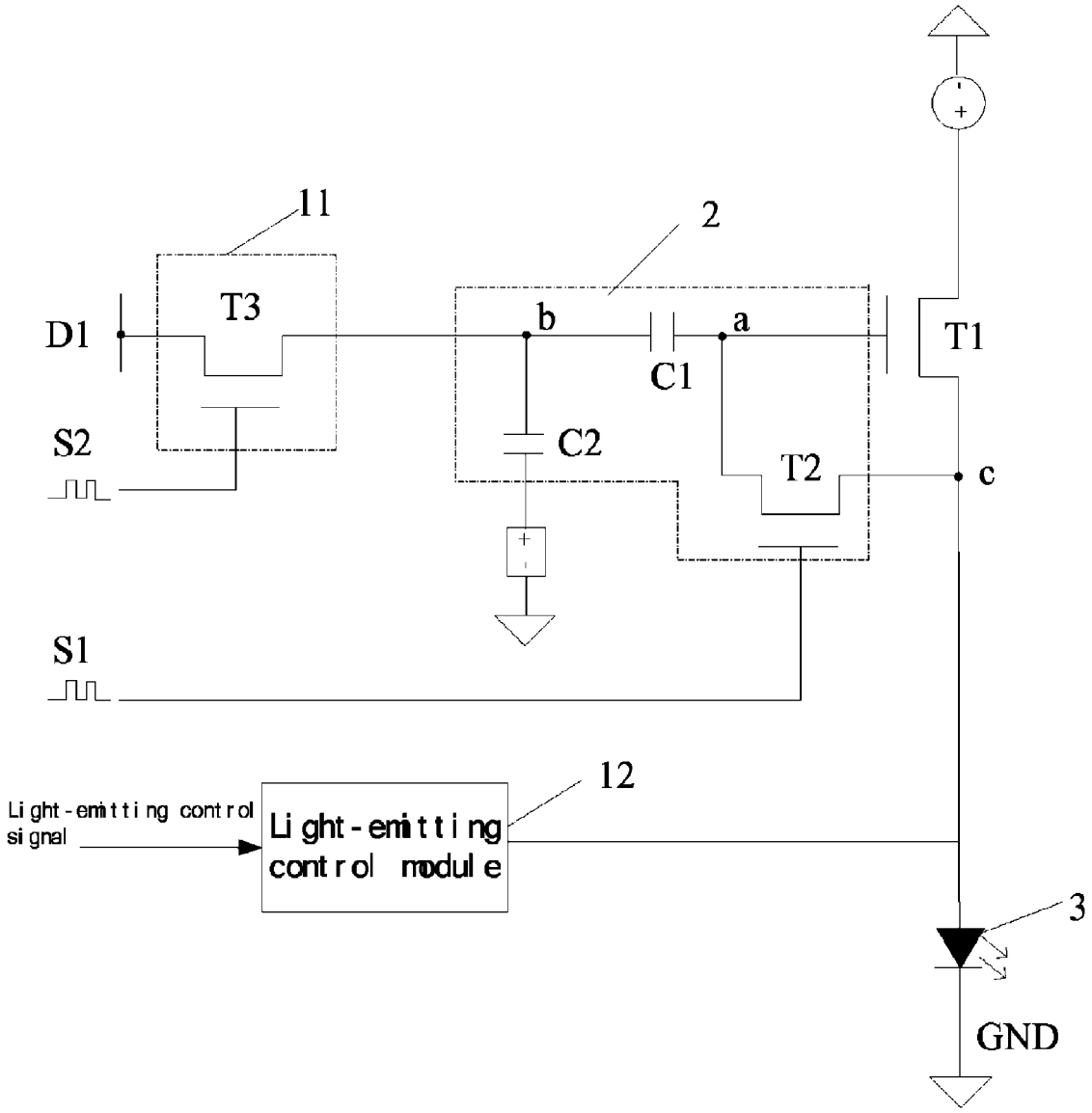
FIG. 4 is a schematic view of a fourth structure of a pixel circuit according to an embodiment of the present invention.

In some embodiments, the charging control module 11 may include a second switch transistor T3, as illustrated in FIG. 4, which is a schematic view of structure of a pixel circuit. In FIG. 4, the drain of the second switch transistor T3 is connected to a data voltage source D1. For example, the charging signal may be the data voltage signal from the data voltage source D1. The gate of the second switch transistor T3 is connected to a second gate signal source S2. For example, the scanning signal may be a signal from the second gate signal source S2. The source of the second switch transistor T3 is connected with the first end of the first capacitor C1 and the second end of the second capacitor C2 (i.e., the first end of the first capacitor C1, the second end of the second capacitor C2 and the source of the second switch transistor T3 together are connected to the node "b"). The second switch transistor T3, under the control of the scanning signal and the charging signal, can control charging and discharging of the first capacitor C1 and the second capacitor C2, thus enabling the potential at the connection end of the first capacitor C1 and the second capacitor C2 to be reset as the potential of the reference reset voltage, and store the reference reset voltage at the node "b." The first gate signal source S1 is connected with the gate of the first switch transistor T2, and controls switch-on and/or switch-off of the first switch transistor T2. When the first switch transistor T2 is switched on, the driving transistor T1 switches to the diode connection mode, thus enabling the first capacitor C1 to be charged and discharged. Additionally, this enables the driving transistor T1 to enter a switch-off state, which further enables the first capacitor C1 to store the threshold voltage of the driving transistor T1 and store the threshold voltage of the driving transistor T1.

Figure 5:
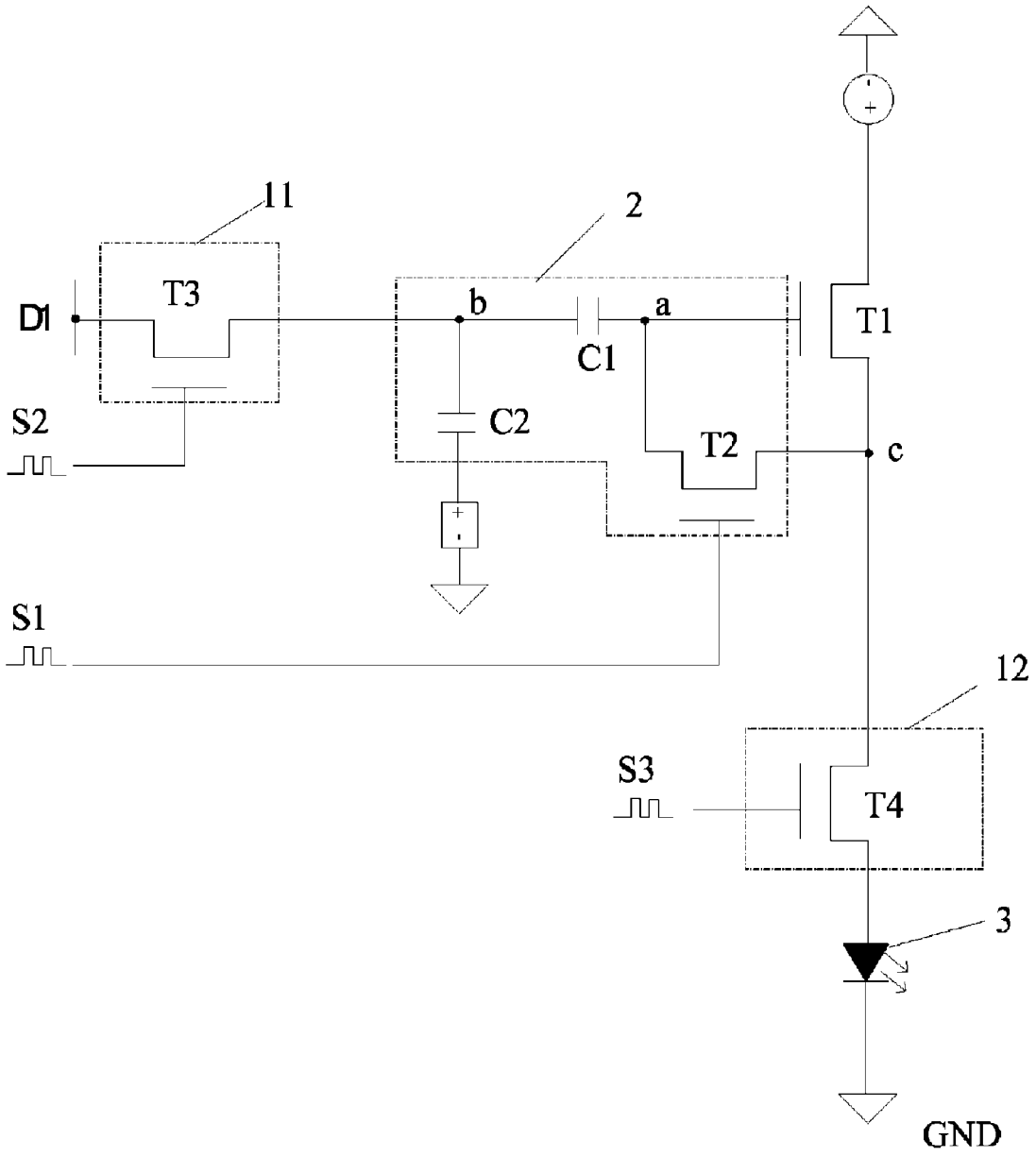
FIG. 5 is a schematic view of a fifth structure of a pixel circuit according to an embodiment of the present invention.

In some embodiments, the light-emitting control module 12 may include a third switch transistor T4, as illustrated in FIG. 5. In FIG. 5, the gate of the third switch transistor T4 is connected to a third gate signal source S3, which outputs a level signal that controls switch-on or switch-off of the third switch transistor. The drain of the third switch transistor T4 is connected with the source of the driving transistor T1. The source of the third switch transistor T4 is connected to the first end of the light emitting device 3. The third switch transistor T4 can, under the control of the light-emitting control signal, control whether the light emitting device 3 emits or does not emit light. When the third switch transistor T4 is switched on, the light emitting device 3 can be controlled to emit light. In embodiments where the light emitting device 3 is an OLED, the first end may be the anode of the OLED, i.e., the source of the third switch transistor T4 is connected to the anode of the OLED.

In some embodiments, the second end (e.g., the cathode of the OLED) of the light emitting device 3 that is not connected with the third switch transistor T4 is connected to a ground circuit. The ground circuit may be a common ground potential in the display panel, which is represented by GND in FIG. 5.

In some embodiments, the first switch transistor T2, the second switch transistor T3, and the third switch transistor T4 may be N-type transistors and/or P-type transistors. Preferably, the first switch transistor T2, the second switch transistor T3, and the third switch transistor T4 are either all P-type transistors or are all N-type transistors, so as to simplify the driving timing that drives the pixel circuit.

In some embodiments, the compensation sub-circuit perform the electric potential reset and store the threshold voltage of the driving transistor under the control of the control sub-circuit. Additionally, the compensation sub-circuit may regulate the threshold voltage of the driving transistor when the light emitting device is emitting light, thus allowing for the driving current to the light emitting device to be uncorrelated with the threshold voltage of the driving transistor, thus improving display uniformity of the panel.

An embodiment of the present invention further provides a driving method of the pixel circuit described herein. Specifically, the process of driving the light emitting device to emit light and realizing image display by the pixel circuit comprises an initialization phase, a data writing phase, and a light-emitting phase. The specific driving process is as follows:

Initialization phase: A variable voltage source outputs a low potential voltage to a drain of a driving transistor. A control sub-circuit controls a compensation sub-circuit to resets the electric potential. The control sub-circuit controls the driving transistor to enter into a switch-off state so as to enable the compensation sub-circuit to store a threshold voltage of the driving transistor.

Data writing phase: The variable voltage source outputs a high potential voltage to the drain the driving transistor. The control sub-circuit controls a data voltage signal that drives the light emitting device to emit light to be written into the compensation sub-circuit.

Light-emitting phase: The variable voltage source outputs a high potential voltage to the drain of the driving transistor. The control sub-circuit and the compensation sub-circuit control the driving transistor to drive the light emitting device to emit light. The threshold voltage of the driving transistor is compensated by the threshold voltage stored by the compensation sub-circuit, thereby enabling a driving current generated by the driving transistor to be uncorrelated with the threshold voltage of the driving transistor.

In some embodiments, the compensation sub-circuit can accomplish electric potential reset and store the threshold voltage of the driving transistor. The control sub-circuit, under the control of the light-emitting control signal, controls the driving transistor to drive the light emitting device to emit light. Using the threshold voltage, the compensation sub-circuit compensates the threshold voltage provided by the driving transistor, such that the driving current is uncorrelated with the threshold voltage of the driving transistor, thereby improving display uniformity of the panel.

Further, the compensation sub-circuit may be comprised of a first capacitor, a second capacitor and a first switch transistor. In the process of driving the pixel circuit as shown in FIG. 2, the compensation circuit may reset electric potential and control the driving transistor to enter the switch-off state so as to enable the compensation sub-circuit to store the threshold voltage of the driving transistor. For example, the following ways may be adopted:

First, the reference voltage source outputs potential of the reference reset voltage. The control sub-circuit facilitates charging and discharging of the first capacitor and the second capacitor such that the potential stored at the connection end of the first capacitor and the second capacitor is reset as the potential of the reference reset voltage.

Next, the first gate signal source outputs a level signal that enables the first switch transistor to be switched on so as to enable the driving transistor to be in a diode connection mode. The signal causes the first capacitor to be charged and discharged in the diode connection mode of the driving transistor thus enabling the driving transistor to enter into the switch-off state, Additionally, the first gate signal source enables the first capacitor to store the threshold voltage of the driving transistor, thereby enabling the driving transistor to enter into the switch-off state at the same time of as the reset occurs and thus the threshold voltage of the driving transistor is stored.

In some embodiments, the control sub-circuit is comprised of a charging control module and a light-emitting control module. the charging control module may includes a second switch transistor and the light-emitting control module may include a third switch transistor. The process of driving the pixel circuit as shown in FIG. 5 for example may adopt the following ways:

An initialization phase, which specifically comprises: the first gate signal source outputs a level signal that enables the first switch transistor to be switched on. A second gate signal source outputs a level signal that enables the second switch transistor to be switched on. A third gate signal source outputs a level signal that enables the third switch transistor to be switched off. The reference voltage source outputs the potential of the reference reset voltage to an end of the second capacitor that is not connected with the first capacitor. The data voltage source outputs a low potential voltage to the connection end of the first capacitor and the second capacitor through the switched-on second switch transistor, thus enabling the connection end of the first capacitor and the second capacitor to store the potential of the reference reset voltage. Finally, an end of the first capacitor that is not connected with the second capacitor is charged and discharged in the diode connection mode of the driving transistor, thus enabling the driving transistor to enter the switch-off state, enabling the first capacitor to store the threshold voltage of the driving transistor.

A data writing phase, which specifically comprises:

the first gate signal source outputting a level signal that enables the first switch transistor to be switched off, the second gate signal source outputting a level signal that enables the second switch transistor to be switched on, the third gate signal source outputting a level signal that enables the third switch transistor to be switched off, the data voltage source outputting a data voltage signal, the second capacitor storing the data voltage.

A light-emitting phase, which specifically comprises: the first gate signal source outputs a level signal that enables the first switch transistor to be switched off. The second gate signal source outputs a level signal that enables the second switch transistor to be switched off. The third gate signal source outputs a level signal that enables the third switch transistor to be switched on. The driving transistor drives the light emitting device to emit light. The threshold voltage of the driving transistor is compensated by the threshold voltage stored by the first capacitor, enabling the current value of the driving current generated by the driving transistor to be uncorrelated with the threshold voltage of the driving transistor.

The driving implementing mode of the pixel circuit will be explained specially in combination with the pixel circuit in FIG. 5. It should be noted that, as described with respect to FIG. 5, the first switch transistor T2, the second switch transistor T3 and the third switch transistor T4 are all N-type transistors. In some implementations, the first switch transistor T2, the second switch transistor T3 and the third switch transistor T4 may all be P-type transistors and operate similar to the illustrated configuration, but with a contrary corresponding signal level.

Figure 6:
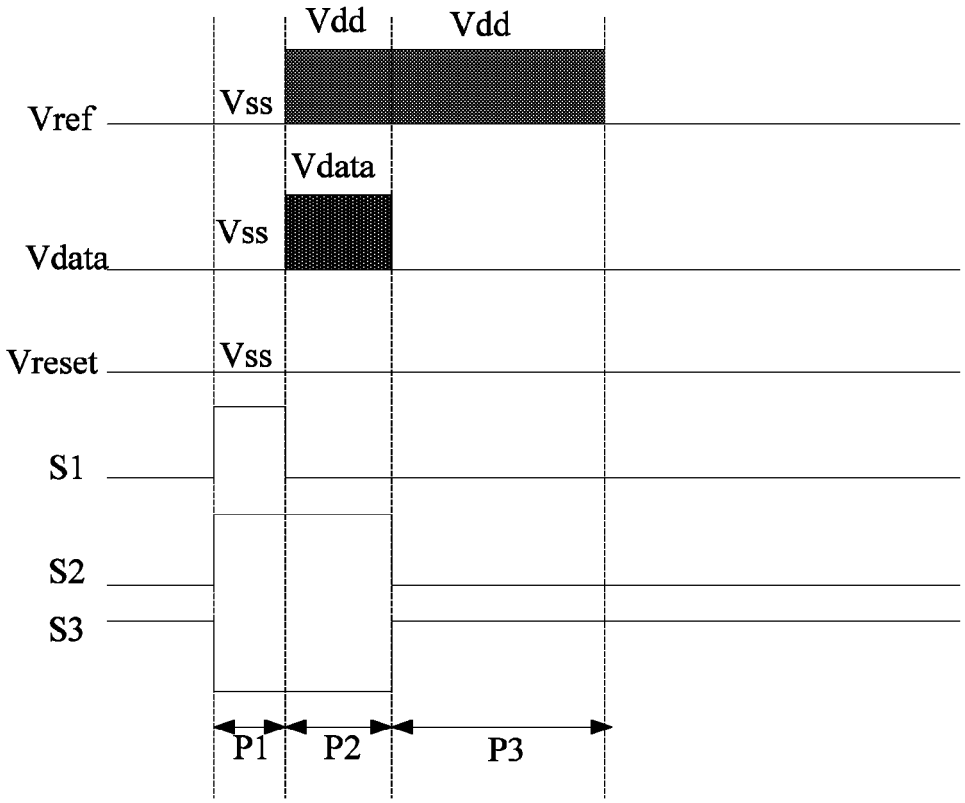
FIG. 6 is a driving timing diagram of a pixel circuit according to an embodiment of the present invention.

FIG. 6 shows a driving timing diagram of a pixel circuit in an embodiment where the first switch transistor T2, the second switch transistor T3 and the third switch transistor T4 are all N-type transistors. The diagram illustrates the timing of an initialization phase P1, a data writing phase P2, and a light-emitting phase P3. A corresponding circuit diagram is shown in FIG. 7A.

In the initialization phase, the first gate signal source S1 outputs a high level signal to make the first switch transistor T2 switch on. The second gate signal source S2 outputs a high level signal to make the second switch transistor T3 switch on. The third gate signal source S3 outputs a low level signal to make the third switch transistor T4 switch off.

Figure 7A:
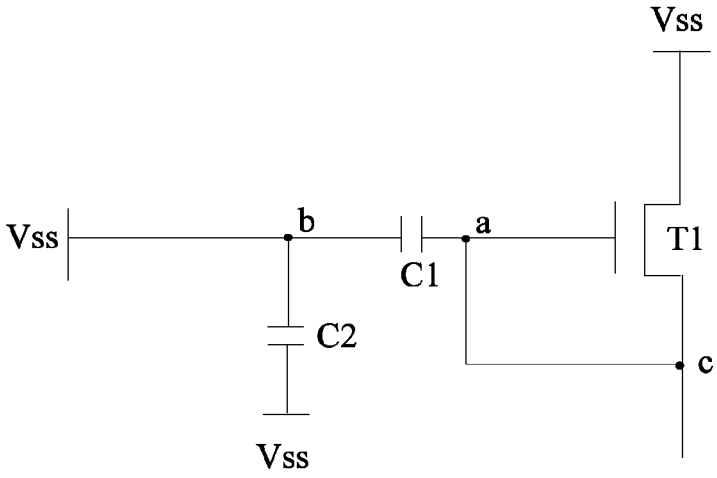
FIG. 7A-FIG. 7C are equivalent circuit diagrams of different phases of a pixel circuit according to an embodiment of the present invention.

In FIG. 7A, when the second switch transistor T3 is switched on, the data voltage signal Vdata outputted by the data voltage source is a low potential Vss. The potential Vreset of the reference reset voltage outputted by the reference voltage source is Vss. The power signal Vref outputted by the variable voltage source is also a low potential Vss. In the initialization phase, the first capacitor C1 and the second capacitor C2 will be reset such that the data voltage stored by the first capacitor C1 and the second capacitor C2 in the previous display phase will be eliminated, and the lower potential Vss will be stored at node "b," thus resetting electric potential reset.

In the equivalent circuit diagram as shown in FIG. 7A, the first switch transistor T2 is switched on, such that the source and the gate of the is driving transistor T1 are connected (this connection is illustrated as an open connection between node "a" and node "c"). The first capacitor C1 is charged and discharged in the diode connection mode of the driving transistor T1 until the driving transistor T1 is switched off finally, thereby enabling the voltage at the node "a," which connects the first capacitor C1, the first switch transistor T2, and the gate of the driving transistor T1, to be Vss+Vth (Vth is a threshold voltage of the driving transistor T1). The first capacitor C1 stores the threshold voltage of the driving transistor T1.

In some embodiments, resetting the first capacitor C1 and the second capacitor C2, as well as storing of the threshold voltage Vth of the driving transistor T1, occur simultaneously in the initialization phase through the above driving mode.

Figure 7B:
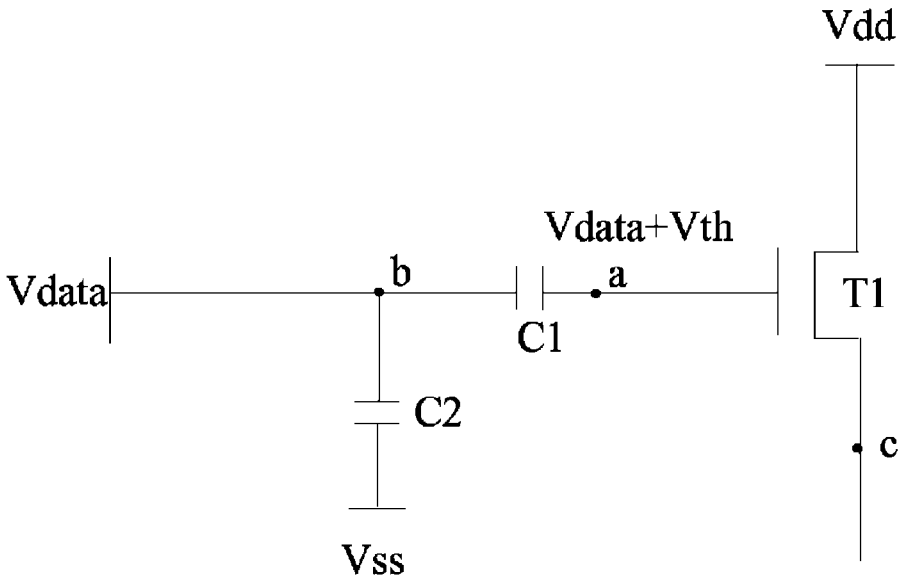

In the data writing phase, the first gate signal source S1 outputs a low level signal to make the first switch transistor T2 switch off; the second gate signal source S2 outputs a high level signal to make the second switch transistor T3 switch on; the third gate signal source S3 outputs a low level signal to make the third switch transistor T4 switch off. An equivalent circuit diagram is shown in FIG. 7B.

The voltage level of the power signal Vref outputted by the variable voltage source is a high potential Vdd. The data voltage signal outputted by the data voltage source is a data voltage Vdata for driving the light emitting device to emit light. The data voltage Vdata is inputted to the node "b" and is stored in the second capacitor C2. Based on the boosting effect of the first capacitor C1, the potential of the node "a" will be boosted to Vdata+Vth.

Figure 7C:
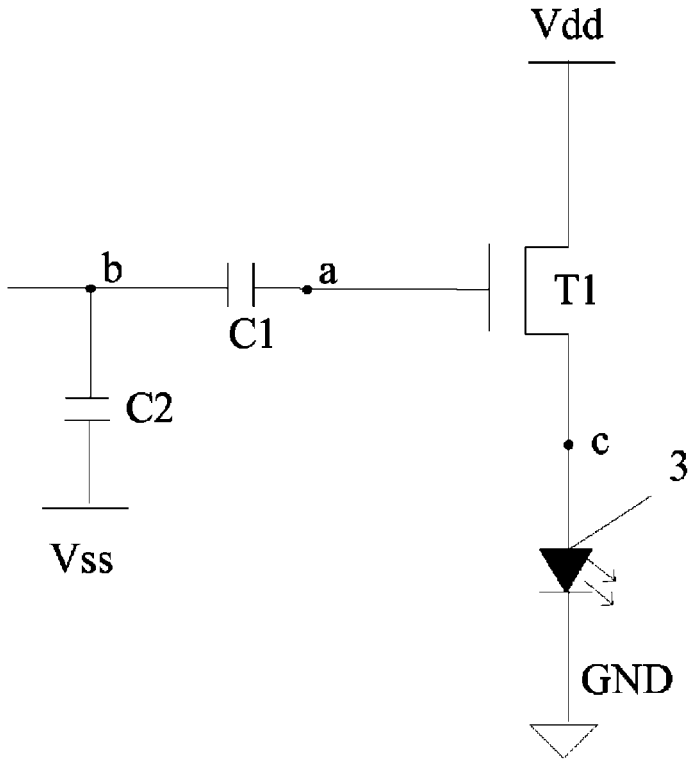

In the light-emitting phase, as shown in FIG. 7C, the first gate signal source S1 outputs a low level signal to make the first switch transistor T2 switch off (denoted by an absence of a connection between nodes "a" and "c"). The second gate signal source S2 outputs a low level signal to make is the second switch transistor T3 switch off (denoted by absence of a Vdata signal entering node "b"). The third gate signal source S3 outputs a high level signal to make the third switch transistor T4 switch on (denoted by an open connection between node "c" and the diode).

In the equivalent circuit diagram shown in FIG. 7C, the third switch transistor T4 is switched on, thereby making the gate-source voltage of the driving transistor T1 Vgs=Vdata+Vth−Voled, wherein the Voled is the voltage across the OLED. Therefore, the driving current $I_{OLED}$ generated by the driving transistor T1 in the embodiment of the present invention may be expressed in the following equation:

$$I_{OLED} = \frac{1}{2}K \times (Vgs - Vth)^2 = \frac{1}{2}K \times (Vdata + Vth - Voled - Vth)^2 = \frac{1}{2}K \times (Vdata - Voled)^2$$

wherein K is a current constant of the driving transistor T1. Voled will also tend to a constant voltage after long time use. Therefore, from the above equation, it can be seen that the driving current $I_{OLED}$ flowing through the light emitting device 3 (e.g. an OLED) in the light-emitting phase is uncorrelated with the threshold voltage (Vth) of the driving transistor T1, thus the non-uniformity of the display panel can be effectively improved, so as to make the display brightness more uniform.

In some embodiments, the driving mode of the pixel circuit, by inputting a variable reference voltage through the variable voltage source, resets electric potential and stores the threshold voltage of the driving transistor simultaneously, and can compensate the threshold voltage of the driving transistor better when the driving transistor drives the light emitting device to emit light. Additionally, the driving current that drives the light emitting device to emit light is not correlated with the threshold voltage of the driving transistor, thus improving display uniformity of the panel.

In order to accomplish electric potential reset and storing of the threshold voltage of the driving transistor in the above initialization phase, the first gate signal source S1 and the second gate signal source S2 are required to output a corresponding level control signal, respectively, to control switch-on of the first switch transistor T2 and the second switch transistor T3. Thus, a lower potential Vss is outputted through the data voltage source so that the first capacitor C1 and the second capacitor C2 are reset. The lower potential Vss is stored at the node "b," resetting electric potential. In other words, when performing pixel circuit driving using the pixel circuit, as shown in FIG. 5, output timing of the data voltage source needs to be changed to cause the resetting, and therefore, the control of the driving timing is relatively complex. In addition, since a turn-on voltage exists when the first switch transistor T2 is switched on, in the event that the turn-on voltage cannot be ignored, the voltage stored by the first capacitor C1 will comprise the turn-on voltage of the first switch transistor T2. To compensate for this, another pixel circuit may be included in an embodiment of the present invention additionally including a fourth switch transistor T5, as shown in FIG. 8.

Figure 8:
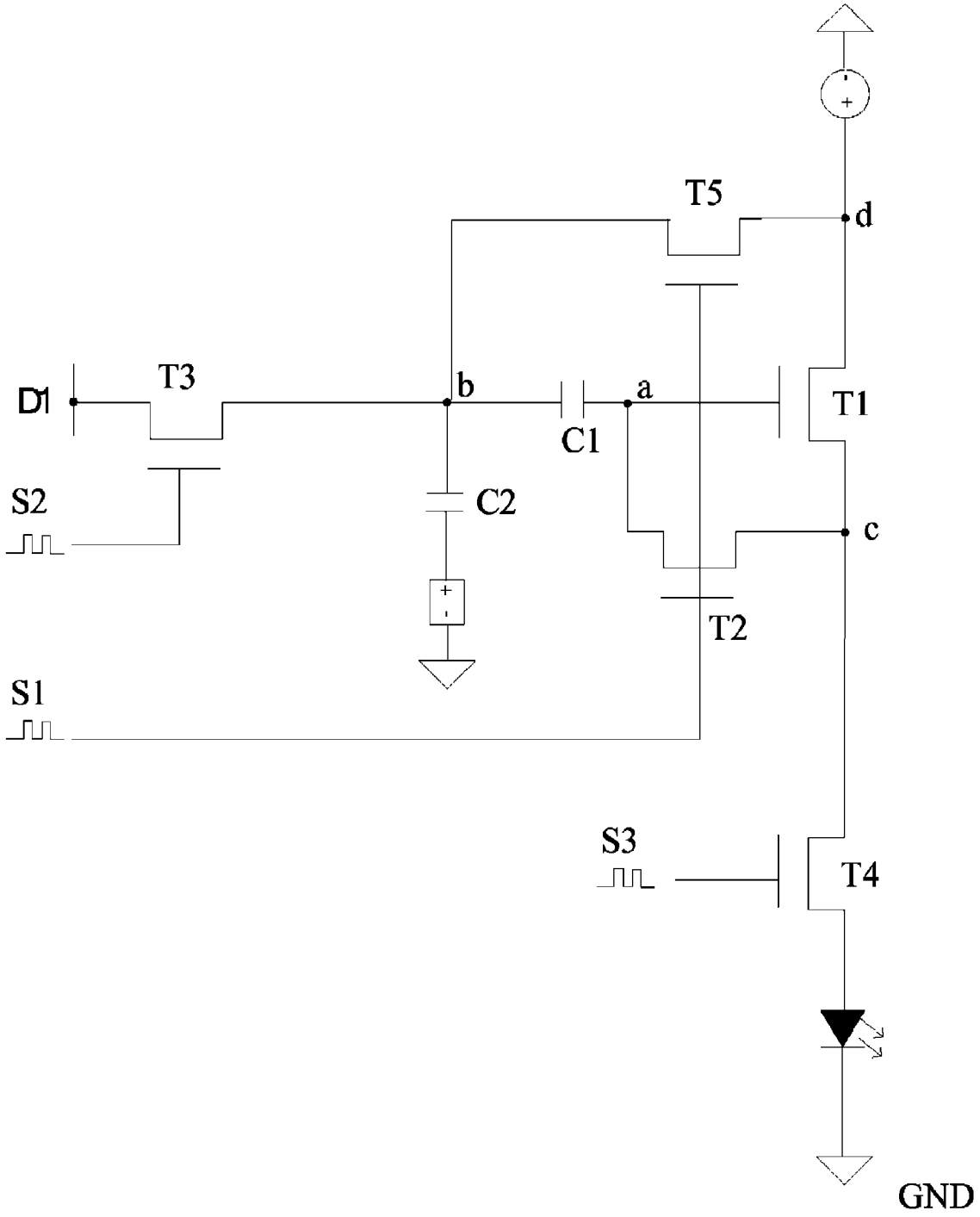
FIG. 8 is a schematic view of a sixth structure of a pixel circuit according to an embodiment of the present invention.

In FIG. 8, the gate of the fourth switch transistor T5 is connected with the first gate signal source S1. The drain of the fourth switch transistor T5 is connected with the second end of the second capacitor C2, and the first end of the first capacitor C1. In other words, the drain of the fourth switch transistor T5 is connected to the node "b" and the source of the fourth switch transistor T5 and the drain of the driving transistor are connected to the node "d." Therefore, in the initialization phase, the variable voltage source can write the low potential voltage to the connection end "b" of the first capacitor C1 and the second capacitor C2 through the switched-on fourth switch transistor T5, thereby realizing resetting of the first capacitor C1 and the second capacitor C2, and accomplishing electric potential reset, without changing the driving timing of the output signal of the data voltage source.

The process of driving the pixel circuit as shown in FIG. 8 in the embodiment of the present invention comprises:

An initialization phase, which specifically comprises:

The first gate signal source outputs a level signal that enables the first switch transistor and the fourth switch transistor to be switched on. The second gate signal source outputs a level signal that enables the second switch transistor to be switched off. The third gate signal source outputs a level signal that enables the third switch transistor to be switched off. The reference voltage source outputs the potential of the reference reset voltage to an end of the second capacitor that is not connected with the first capacitor. The variable voltage source outputs a low potential voltage to the connection end of the first capacitor and the second capacitor through the switched-on fourth switch transistor. The connection end of the first capacitor and the second capacitor stores the potential of the reference reset voltage. An end of the first capacitor that is not connected with the second capacitor is charged and discharged in the diode connection mode of the driving transistor to enable the driving transistor to enter into the switch-off state which enables the first capacitor to store the threshold voltage of the driving transistor.

In some embodiments, in the data writing phase, the following steps may occur:

the first gate signal source outputs a level signal that enables the first switch transistor and the fourth switch transistor to be switched off. The second gate signal source outputs a level signal that enables the second switch transistor to be switched on. The third gate signal source outputs a level signal that enables the third switch transistor to be switched off. Finally, the data voltage source outputs a data voltage signal so that the second capacitor stores the data voltage.

In some embodiments, in a light-emitting phase, the following steps may occur:

The first gate signal source outputs a level signal that enables the first switch transistor and the fourth switch transistor to be switched off. The second gate signal source outputs a level signal that enables the second switch transistor to be switched off. The third gate signal source outputs a level signal that enables the third switch transistor to be switched on. The driving transistor driving the light emitting device causes the device to emit light. Finally, the threshold voltage of the driving transistor is compensated by the threshold voltage stored by the first capacitor, thereby enabling the current value of the driving current generated by the driving transistor to be uncorrelated with the threshold voltage of the driving transistor.

Figure 9:
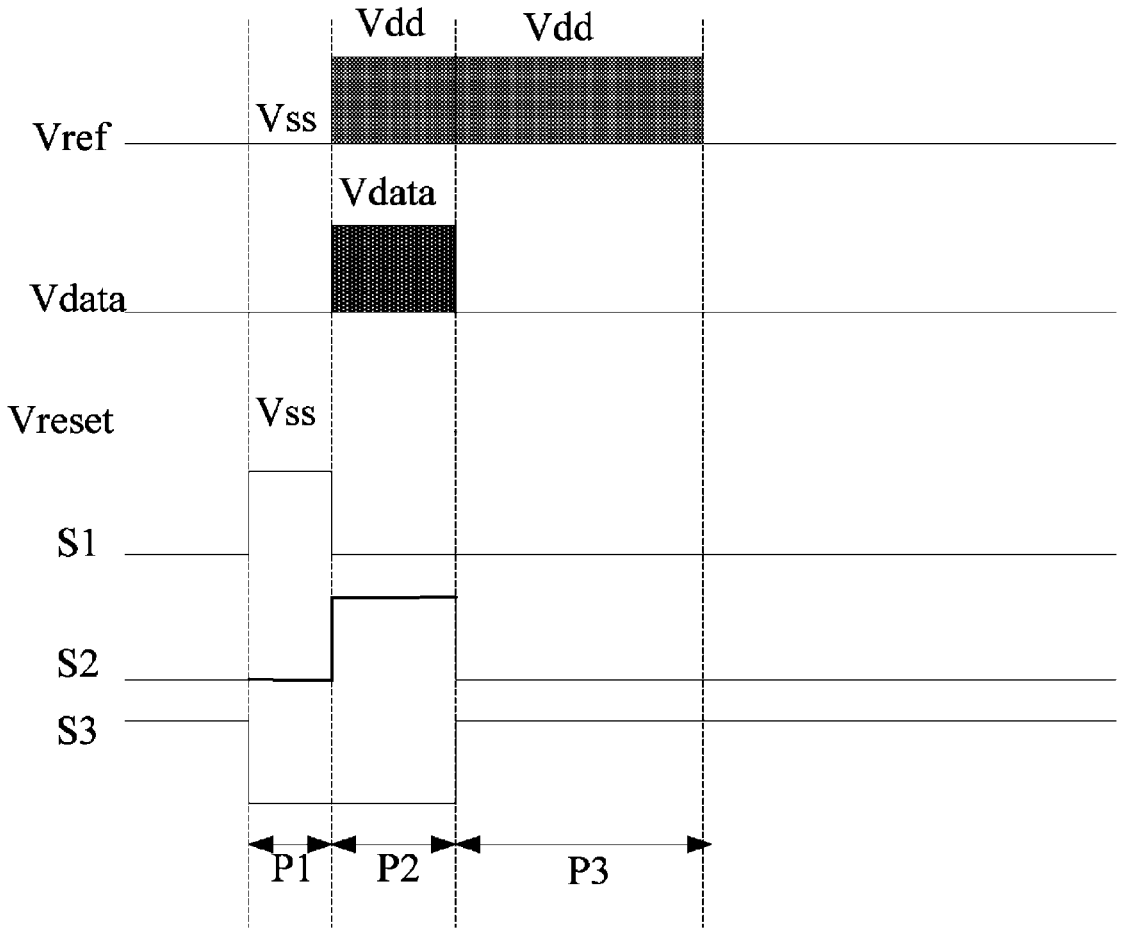
FIG. 9 is a driving timing diagram of a further pixel circuit according to an embodiment of the present invention.

Next, the driving implementing mode of the pixel circuit in FIG. 8 will be explained in detail in combination with the driving timing diagram of a pixel circuit as shown in FIG. 9. It should be noted that the illustrated embodiment is described with the first switch transistor T2, the second switch transistor T3, the third switch transistor T4, and the fourth switch transistor T5 as all N-type transistors. Alternate embodiments may include the first switch transistor T2, the second switch transistor T3, the third switch transistor T4, and/or the fourth switch transistor T5 as P-type transistors, which would be similar to the illustrated embodiment, but with a contrary corresponding signal level.

The driving timing of the pixel circuit, as shown in FIG. 9, is primarily comprised of an initialization phase P1, a data writing phase P2, and a light-emitting phase P3. The driving implementing process of the pixel circuit shown in FIG. 8 and the driving implementing process of the pixel circuit shown in FIG. 5 are different only in the initialization phase. The other phases are similar. Therefore, only the differences between the initialization process will explained. Phases sharing similarities will not be repeated here.

In the initialization phase, the first gate signal source S1 outputs a high level signal to make the first switch transistor T2 and the fourth switch transistor T5 switch on. The second gate signal source S2 outputs a low level signal to make the second switch transistor T3 switch off. The third gate signal source S3 outputs a low level signal to make the third switch transistor T4 switch off.

The potential Vreset of the reference reset voltage outputted by the reference voltage source and the power signal Vref outputted by the variable voltage source are both a low potential Vss. The low potential signal outputted by the variable voltage source can be written into the connection end, i.e., node "b," of the first capacitor C1 and the second capacitor C2 through the switched-on fourth switch transistor T5. Therefore, the difference in this phase from the pixel circuit in FIG. 5 is that the data voltage source does not need to output a low level voltage to realize resetting of the first capacitor C1 and the second capacitor C2. Instead, the data voltage stored at the first capacitor C1 and the second capacitor C2 in the previous display phase can be eliminated. The low potential Vss can also be stored in the node "b," so as to reset electric potential.

As an example, assume that if the turn-on voltage of the switch transistor is not ignored, the turn-on voltage of respective switch transistors is Vk. In the initialization phase, when the first switch transistor T2 and the fourth switch transistor T5 are switched on, the potential at node "b" is Vss+Vk, the potential at node "c" is Vss+Vth, and the potential at node "a" is Vss+Vth+Vk. The voltage stored at the first capacitor C1 would then be (Vss+Vth+Vk)−(Vss+Vk)=Vth. In other words, the influence of the turn-on voltage of the fourth switch transistor T5 and the first switch transistor T2 can be avoided by using the pixel circuit as shown in FIG. 8.

It should be noted that, in some embodiments, the first switch transistor T2, the second switch transistor T3, the third switch transistor T4, and the fourth switch transistor T5 may be thin film transistors of the same type, and may also be thin film transistors of different types (P-type and/or N-type, for example). Alternate types for one or more of the transistors may be implemented with adjustments to corresponding timing to implement the above embodiments. Therefore, variations will not be defined here in detail. In order to simplify the fabrication process in the embodiment of the present invention, the first switch transistor T2, the second switch transistor T3, the third switch transistor T4, and the fourth switch transistor T5 preferably are all P-type transistors or are all N-type transistors.

Some embodiments may include a the pixel circuit according to the above description, and additionally include a display panel. The display panel may include pixel units arranged in a matrix and defined by gate lines and data lines, and each of the pixel units may include a pixel circuit, as previously described.

Figure 10:
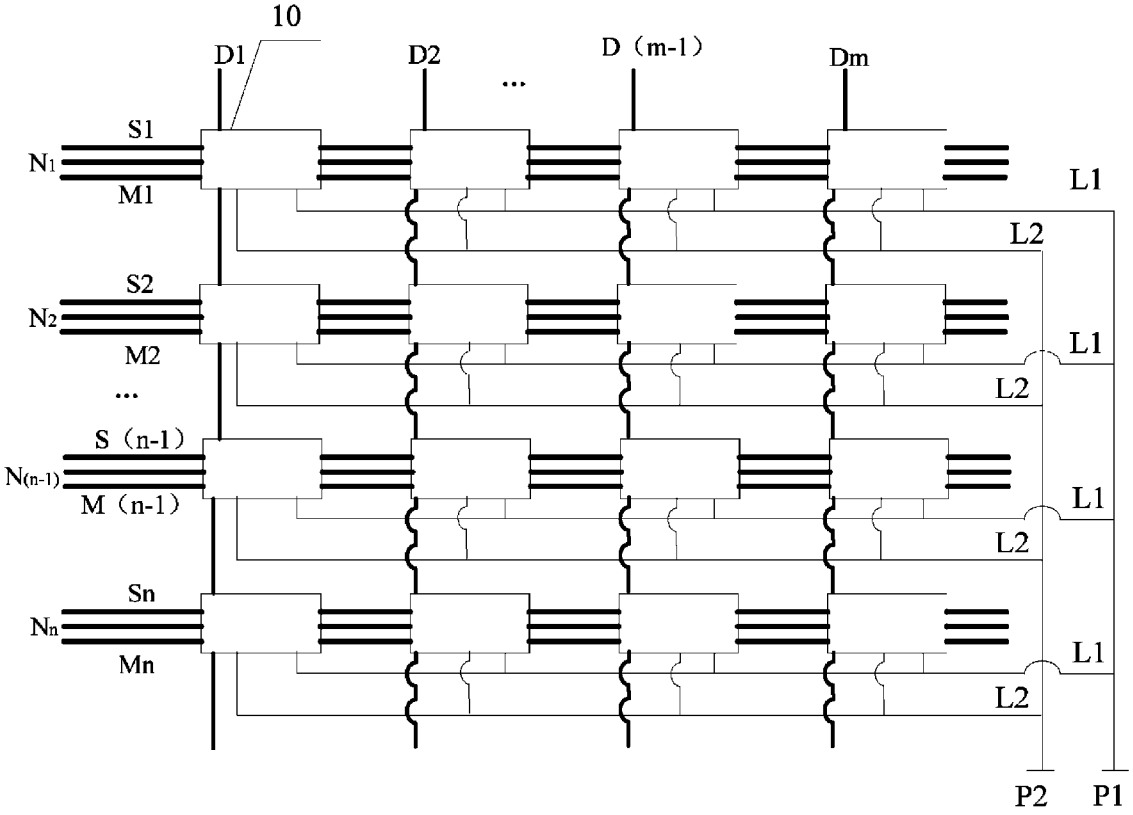
FIG. 10 is a schematic view of structure of a display panel according to an embodiment of the present invention.

FIG. 10 shows a schematic view of structure of a display panel of an embodiment that includes a display panel. The display panel shown in FIG. 10 includes a plurality of gate lines distributed along line direction, S1, S2, . . . , Sn and a plurality of data lines distributed along column direction, D1, D2, . . . , Dm. Adjacent gate lines and data lines define a pixel unit 10 and a plurality of the gate lines and a plurality of the data lines define pixel units 10 arranged in a matrix. Each of the pixel units is comprised of a pixel circuit 10, with the pixel circuits 10 in the same line connected by a common gate line, and the pixel circuits 10 in the same column are connected with a common data line.

Optimally, the display panel in the illustrated embodiment further includes a first power signal line L1, a second power signal line L2, first control signal lines M1, M2, . . . , Mn and second control signal lines N1, N2, . . . , Nn, with the drain of the driving transistor T1 in the pixel circuit connected with the variable voltage source P1 through the first power signal line L1. The first end of the second capacitor C2 may be connected with the reference voltage source P2 through the second power signal line L2. The gate of the first switch transistor may be connected with the first gate signal source through the first control signal line. The gate of the second switch transistor may be connected with the second gate signal source through the gate line. The drain of the second switch transistor may be connected with the data voltage source through the data line. The gate of the third switch transistor may be connected with the third gate signal source through the second control signal line.

The compensation sub-circuit in the pixel circuit of the illustrated display panel may be under the control of the control sub-circuit. The control sub-circuit can reset electric potential and store the threshold voltage of the driving transistor. Additionally, the control sub-circuit can compensate the threshold voltage of the driving transistor better when the driving transistor drives the light emitting device to emit light. In this configuration, the driving current that drives the light emitting device to emit light is uncorrelated with the threshold voltage of the driving transistor, thus improving display uniformity of the panel.

In some embodiments further includes a display device with a display panel, as described in the above embodiments. Other structures of the display device may be the same as the existing structures, which will not be repeated here.

It should be noted that the display device according to the embodiments of the present invention may be an organic electroluminescent display OLED panel, an OLED display, an OLED TV, electronic paper, and/or other display.

The compensation sub-circuit in the pixel circuit of the display panel of the display device, as described herein, is under the control of the control sub-circuit and can accomplish electric potential reset, store the threshold voltage of the driving transistor, and compensate the threshold voltage of the driving transistor better when the driving transistor drives the light emitting device to emit light, thus enabling the driving current that drives the light emitting device to emit light to be uncorrelated with the threshold voltage of the driving transistor, improving display uniformity of the panel.

A person having skill in the art may make various modifications and variants to the present invention without departing from the spirit and scope of the present invention. In this way, provided that these modifications and variants of the present invention fall within the scopes of claims of the present invention and the equivalents thereof, the present invention also intends to encompass these modifications and variants.

The invention claimed is:

1. A pixel circuit, comprising:

a control sub-circuit;

a compensation sub-circuit;

a driving transistor; and a light emitting device, wherein;

a gate of the driving transistor is connected with the compensation sub-circuit, a drain of the driving transistor is connected with a variable voltage source, and a source of the driving transistor is connected with the light emitting device, wherein the control sub-circuit is connected with the compensation sub-circuit and controls charging and discharging of the compensation sub-circuit under control of a scanning signal and a charging signal; wherein the control sub-circuit is connected with the driving transistor and the light emitting device and controls the driving transistor to drive the light emitting device to emit light under control of a light-emitting control signal, and wherein the compensation sub-circuit performs electric potential reset under control of the control sub-circuit, and is used for storing a threshold voltage of the driving transistor, so as to compensate the threshold voltage of the driving transistor when the driving transistor drives the light emitting device to emit light, wherein the compensation sub-circuit comprises:

a first capacitor;

a second capacitor; and a first switch transistor, wherein a first end of the first capacitor is connected with the control sub-circuit and a second end of the second capacitor, wherein a second end of the first capacitor is connected to the gate of the driving transistor and the drain of the first switch transistor, wherein a first end of the second capacitor is connected with a reference voltage source, and the second end of the second capacitor is connected with the first end of the first capacitor;

wherein a gate of the first switch transistor is connected with a first gate signal source, the drain of the first switch transistor is connected with the gate of the driving transistor and the second end of the first capacitor, and a source of the first switch transistor is connected with the source of the driving transistor;

wherein the control sub-circuit controls charging and discharging of the first capacitor and the second capacitor to enable the electric potential stored at the connection end of the first capacitor and the second capacitor to be reset, and controls the first switch transistor to be switched on, so as to enable the first capacitor to be charged and discharged in a diode connection mode of the driving transistor, thereby enabling the first capacitor to store the threshold voltage of the driving transistor; and wherein the pixel circuit further comprises a fourth switch transistor, wherein a gate of the fourth switch transistor is connected with the first gate signal source, a drain of the fourth switch transistor is directly connected with the second end of the second capacitor and to the first end of the first capacitor, and a source of the fourth switch transistor is connected with the drain of the driving transistor.

2. The pixel circuit of claim 1, wherein the control sub-circuit comprises:

a charging control module; and a light-emitting control module, wherein the charging control module is connected with the first end of the first capacitor and the second end of the second capacitor and controls charging and discharging of the first capacitor and the second capacitor under control of the scanning signal and the charging signal, and enables the electric potential stored at the connection end of the first capacitor and the second capacitor to be reset and controls the first switch transistor to be switched on to enable the first capacitor to be charged and discharged under in the diode connection mode of the driving transistor, thereby enabling the first capacitor to store the threshold voltage of the driving transistor; and further receives a data voltage signal that drives the light emitting device to emit light to control the first capacitor and the second capacitor to store the data voltage for driving the light emitting device to emit light, and wherein the light-emitting control module is connected with the source of the driving transistor as well as the light emitting device to enable the driving transistor to drive the light emitting device to emit light under control of the light-emitting control signal.

3. The pixel circuit as claimed in claim 2, wherein the charging control module comprises a second switch transistor, wherein, a drain of the second switch transistor is connected with a data voltage source, wherein a gate of the second switch transistor is connected with a second gate signal source, and wherein a source of the second switch transistor is connected with the first end of the first capacitor and the second end of the second capacitor.

4. The pixel circuit of claim 3, wherein the light-emitting control module comprises a third switch transistor, wherein a gate of the third switch transistor is connected with a third gate signal source, a drain of the third switch transistor is connected with the source of the driving transistor, and a source of the third switch transistor is connected to the light emitting device.

5. The pixel circuit as claimed in claim 4, wherein the first switch transistor, the second switch transistor, the third switch transistor, and the fourth switch transistor are one of all P-type transistors or all N-type transistors.

6. A method of driving a pixel circuit, the pixel circuit comprising:

a control sub-circuit;

a compensation sub-circuit;

a driving transistor; and a light emitting device, wherein a gate of the driving transistor is connected with the compensation sub-circuit, a drain of the driving transistor is connected with a variable voltage source, and a source of the driving transistor is connected with the light emitting device;

wherein the control sub-circuit is connected with the compensation sub-circuit to control charging and discharging of the compensation sub-circuit under control of a scanning signal and a charging signal, the control sub-circuit is connected with the driving transistor and the light emitting device to control the driving transistor to drive the light emitting device to emit light under control of a light-emitting control signal;

and wherein the compensation sub-circuit performs electric potential reset under control of the control sub-circuit and is used for storing a threshold voltage of the driving transistor to compensate the threshold voltage of the driving transistor when the driving transistor drives the light emitting device to emit light;

wherein the compensation sub-circuit comprises:

a first capacitor;

a second capacitor; and a first switch transistor, wherein a first end of the first capacitor is connected with the control sub-circuit and a second end of the second capacitor, wherein a second end of the first capacitor is connected to the gate of the driving transistor and the drain of the first switch transistor, wherein a first end of the second capacitor is connected with a reference voltage source, and the second end of the second capacitor is connected with the first end of the first capacitor;

wherein a gate of the first switch transistor is connected with a first gate signal source, the drain of the first switch transistor is connected with the gate of the driving transistor and the second end of the first capacitor, and a source of the first switch transistor is connected with the source of the driving transistor;

wherein the control sub-circuit controls charging and discharging of the first capacitor and the second capacitor to enable the electric potential stored at the connection end of the first capacitor and the second capacitor to be reset, and controls the first switch transistor to be switched on, so as to enable the first capacitor to be charged and discharged in a diode connection mode of the driving transistor, thereby enabling the first capacitor to store the threshold voltage of the driving transistor; and wherein the pixel circuit further comprises a fourth switch transistor, wherein a gate of the fourth switch transistor is connected with the first gate signal source, a drain of the fourth switch transistor is directly connected with the second end of the second capacitor and to the first end of the first capacitor, and a source of the fourth switch transistor is connected with the drain of the driving transistor;

the method comprising:

performing an initialization phase, wherein a variable voltage source outputs a low potential voltage to a drain of a driving transistor, a control sub-circuit controls a compensation sub-circuit to perform electric potential reset and controls the driving transistor to enter into a switch-off state to enable the compensation sub-circuit to store a threshold voltage of the driving transistor;

performing a data writing phase, wherein the variable voltage source outputs a high potential voltage to the drain of the driving transistor, the control sub-circuit controls a data voltage signal that drives the light emitting device to emit light to be written into the compensation sub-circuit; and performing a light-emitting phase, wherein the variable voltage source outputs a high potential voltage to the drain of the driving transistor, the control sub-circuit controls the driving transistor to drive the light emitting device to emit light, and the threshold voltage of the driving transistor is compensated by the threshold voltage stored by the compensation sub-circuit, thereby enabling a current value of a driving current generated by the driving transistor to be uncorrelated with the threshold voltage of the driving transistor.

7. The driving method of a pixel circuit in claim 6, and wherein performing the initialization phase includes:

a reference voltage source that outputs potential of a reference reset voltage, the control sub-circuit controls charging and discharging of the first capacitor and the second capacitor, so as to enable the potential stored at the connection end of the first capacitor and the second capacitor to be reset as the potential of the reference reset voltage; and a first gate signal source that outputs a level signal that enables the first switch transistor to be switched on, thereby enabling the driving transistor to be in a diode connection mode, and controlling charging and discharging of the first capacitor in the diode connection mode of the driving transistor, to enable the driving transistor to enter into the switch-off state, thereby enabling the first capacitor to store the threshold voltage of the driving transistor.

8. The driving method of a pixel circuit in claim 7, wherein the pixel circuit further comprises a second switch transistor and a third switch transistor, wherein, the initialization phase comprises:

the first gate signal source outputting a level signal that enables the first switch transistor to be switched on, a second gate signal source outputting a level signal that enables the second switch transistor to be switched on, a third gate signal source outputting a level signal that enables the third switch transistor to be switched off, the reference voltage source outputting the potential of the reference reset voltage to an end of the second capacitor that is not connected with the first capacitor, the data voltage source outputting a low potential voltage to the connection end of the first capacitor and the second capacitor through the switched on second switch transistor, so as to enable the connection end of the first capacitor and the second capacitor to store the potential of the reference reset voltage, the first capacitor is charge and discharged in the diode connection mode of the driving transistor, so as to enable the driving transistor to enter into the switch-off state, thereby enabling the first capacitor to store the threshold voltage of the driving transistor;

wherein the data writing phase comprises the steps of:

the first gate signal source outputting a level signal that enables the first switch transistor to be switched off, the second gate signal source outputting a level signal that enables the second switch transistor to be switched on, the third gate signal source outputting a level signal that enables the third switch transistor to be switched off, the data voltage source outputting a data voltage signal, and the second capacitor storing the data voltage; and wherein the light-emitting phase comprises the steps of:

the first gate signal source outputting a level signal that enables the first switch transistor to be switched off, the second gate signal source outputting a level signal that enables the second switch transistor to be switched off, the third gate signal source outputting a level signal that enables the third switch transistor to be switched on, the driving transistor driving the light emitting device to emit light, and the threshold voltage of the driving transistor being compensated by the threshold voltage stored by the first capacitor, thereby enabling the current value of the driving current generated by the driving transistor to be uncorrelated with the threshold voltage of the driving transistor.

9. The method of driving a pixel circuit of claim 8, wherein performing the initialization phase comprises:

the first gate signal source outputting a level signal that enables the first switch transistor and the fourth switch transistor to be switched on, the second gate signal source outputting a level signal that enables the second switch transistor to be switched off, the third gate signal source outputting a level signal that enables the third switch transistor to be switched off, the reference voltage source outputting the potential of the reference reset voltage to an end of the second capacitor that is not connected with the first capacitor, the variable voltage source outputting a low potential voltage to the connection end of the first capacitor and the second capacitor through the switched on fourth switch transistor, the connection end of the first capacitor and the second capacitor storing the potential of the reference reset voltage, the first capacitor being charged and discharged in the diode connection mode of the driving transistor, so as to enable the driving transistor to enter into the switch-off state, thereby enabling the first capacitor to store the threshold voltage of the driving transistor; and wherein the data writing phase comprises:

the first gate signal source outputting a level signal that enables the first switch transistor and the fourth switch transistor to be switched off, the second gate signal source outputting a level signal that enables the second switch transistor to be switched on, the third gate signal source outputting a level signal that enables the third switch transistor to be switched off, the data voltage source outputting a data voltage signal, the second capacitor storing the data voltage; and wherein the light-emitting phase comprises:

the first gate signal source outputting a level signal that enables the first switch transistor and the fourth switch transistor to be switched off, the second gate signal source outputting a level signal that enables the second switch transistor to be switched off, the third gate signal source outputting a level signal that enables the third switch transistor to be switched on, the driving transistor driving the light emitting device to emit light, and the threshold voltage of the driving transistor being compensated by the threshold voltage stored by the first capacitor, thereby enabling the current value of the driving current generated by the driving transistor to be uncorrelated with the threshold voltage of the driving transistor.

10. A display panel, comprising:

pixel units arranged in a matrix and defined by gate lines and data lines, wherein each of the pixel units comprises a pixel circuit, wherein the pixel circuit comprises:

a control sub-circuit;

a compensation sub-circuit;

a driving transistor; and a light emitting device, wherein a gate of the driving transistor is connected with the compensation sub-circuit, a drain of the driving transistor is connected with a variable voltage source, a source of the driving transistor is connected with the light emitting device; wherein the control sub-circuit is connected with the compensation sub-circuit for controlling charging and discharging of the compensation sub-circuit under control of a scanning signal and a charging signal; wherein the control sub-circuit is connected with the driving transistor and the light emitting device, for controlling the driving transistor to drive the light emitting device to emit light under control of a light-emitting control signal; and wherein the compensation sub-circuit performs electric potential reset under control of the control sub-circuit, and is used for storing a threshold voltage of the driving transistor, so as to compensate the threshold voltage of the driving transistor when the driving transistor drives the light emitting device to emit light wherein the compensation sub-circuit comprises:

a first capacitor;

a second capacitor; and a first switch transistor, wherein a first end of the first capacitor is connected with the control sub-circuit and a second end of the second capacitor, wherein a second end of the first capacitor is connected to the gate of the driving transistor and the drain of the first switch transistor, wherein a first end of the second capacitor is connected with a reference voltage source, and the second end of the second capacitor is connected with the first end of the first capacitor;

wherein a gate of the first switch transistor is connected with a first gate signal source, the drain of the first switch transistor is connected with the gate of the driving transistor and the second end of the first capacitor, and a source of the first switch transistor is connected with the source of the driving transistor;

wherein the control sub-circuit controls charging and discharging of the first capacitor and the second capacitor to enable the electric potential stored at the connection end of the first capacitor and the second capacitor to be reset, and controls the first switch transistor to be switched on, so as to enable the first capacitor to be charged and discharged in a diode connection mode of the driving transistor, thereby enabling the first capacitor to store the threshold voltage of the driving transistor; and wherein the pixel circuit further comprises a fourth switch transistor, wherein a gate of the fourth switch transistor is connected with the first gate signal source, a drain of the fourth switch transistor is directly connected with the second end of the second capacitor and to the first end of the first capacitor, and a source of the fourth switch transistor is connected with the drain of the driving transistor.

11. The display panel of claim 10, further comprising:

a first power signal line;

a second power signal line;

a first control signal line; and a second control signal line, wherein the pixel circuit further comprises a second switch transistor and a third switch transistor, wherein a drain of the driving transistor is connected with a variable voltage source through the first power signal line;

wherein a first end of the second capacitor is connected with a reference voltage source through the second power signal line;

wherein a gate of the first switch transistor is connected with a first gate signal source through the first control signal line;

wherein a gate of the second switch transistor is connected with a second gate signal source through the gate line, a drain of the second switch transistor is connected with a data voltage source through the data line; and wherein a gate of the third switch transistor is connected with a third gate signal source through the second control signal line.

12. A display device, comprising:

a display panel, the display panel comprising pixel units arranged in a matrix and defined by gate lines and data lines, wherein each of the pixel units comprises a pixel circuit, wherein the pixel circuit comprises a control sub-circuit, a compensation sub-circuit, a driving transistor and a light emitting device;

wherein a gate of the driving transistor is connected with the compensation sub-circuit, a drain of the driving transistor is connected with a variable voltage source, and a source of the driving transistor is connected with the light emitting device; wherein the control sub-circuit is connected with the compensation sub-circuit, for controlling charging and discharging of the compensation sub-circuit under control of a scanning signal and a charging signal; wherein the control sub-circuit is connected with the driving transistor and the light emitting device, for controlling the driving transistor to drive the light emitting device to emit light under control of a light-emitting control signal; and wherein the compensation sub-circuit performs electric potential reset under control of the control sub-circuit, and is used for storing a threshold voltage of the driving transistor, so as to compensate the threshold voltage of the driving transistor when the driving transistor drives the light emitting device to emit light wherein the compensation sub-circuit comprises:

a first capacitor;

a second capacitor; and a first switch transistor, wherein a first end of the first capacitor is connected with the control sub-circuit and a second end of the second capacitor, wherein a second end of the first capacitor is connected to the gate of the driving transistor and the drain of the first switch transistor, wherein a first end of the second capacitor is connected with a reference voltage source, and the second end of the second capacitor is connected with the first end of the first capacitor;

wherein a gate of the first switch transistor is connected with a first gate signal source, the drain of the first switch transistor is connected with the gate of the driving transistor and the second end of the first capacitor, and a source of the first switch transistor is connected with the source of the driving transistor., wherein the control sub-circuit controls charging and discharging of the first capacitor and the second capacitor to enable the electric potential stored at the connection end of the first capacitor and the second capacitor to be reset, and controls the first switch transistor to be switched on, so as to enable the first capacitor to be charged and discharged in a diode connection mode of the driving transistor, thereby enabling the first capacitor to store the threshold voltage of the driving transistor; and wherein the pixel circuit further comprises a fourth switch transistor, wherein a gate of the fourth switch transistor is connected with the first gate signal source, a drain of the fourth switch transistor is directly connected with the second end of the second capacitor and to the first end of the first capacitor, and a source of the fourth switch transistor is connected with the drain of the driving transistor.

13. The display device of claim 12, wherein the display panel further comprises:

a first power signal line;

a second power signal line;

a first control signal line; and a second control signal line, wherein the pixel circuit further comprises a second switch transistor and a third switch transistor, wherein a drain of the driving transistor is connected with a variable voltage source through the first power signal line;

wherein a first end of the second capacitor is connected with a reference voltage source through the second power signal line;

wherein a gate of the first switch transistor is connected with a first gate signal source through the first control signal line;

wherein a gate of the second switch transistor is connected with a second gate signal source through the gate line, a drain of the second switch transistor is connected with a data voltage source through the data line; and wherein a gate of the third switch transistor is connected with a third gate signal source through the second control signal line.

* * * * *